United States Patent [19]

Young

[11] Patent Number: 4,984,808

[45] Date of Patent: Jan. 15, 1991

[54] COLOR-CRAYONS AND BOARDGAMES COMBINATION SET

[76] Inventor: Jean Young, F 2, No. 52, Tiann Shoei Rd., Taipei, Taiwan

[21] Appl. No.: 521,509

[22] Filed: May 10, 1990

[51] Int. Cl.[5] ..... A63F 3/02; B65D 85/02

[52] U.S. Cl. ..... 273/283; 273/284; 273/285; 273/287; 273/260; 273/290; 206/315.1; 206/579; D19/43; D21/52; D21/53

[58] Field of Search ..... 273/285, 287, 284, 283, 273/260, 288; 206/315.1, 575, 579, 371; D19/43; D21/52, 53

[56] References Cited

U.S. PATENT DOCUMENTS

| | | | |
|---|---|---|---|
| 239,274 | 3/1881 | Schadowsky | 206/371 |
| 636,663 | 11/1899 | Harrison | 273/284 |
| 1,893,732 | 1/1933 | Cutler | 273/284 |
| 3,149,843 | 9/1964 | Braun | 273/283 |
| 4,781,384 | 11/1988 | Bois | 273/284 |

FOREIGN PATENT DOCUMENTS

| | | | |
|---|---|---|---|
| 1291769 | 3/1962 | France | 273/284 |
| 2144046 | 2/1985 | United Kingdom | 273/260 |

*Primary Examiner*—Benjamin Layno

*Attorney, Agent, or Firm*—Varndell Legal Group

[57] ABSTRACT

A color-crayons and board games combination set, which comprises a case formed of two pivoted parts for receiving different chessboards and pieces. The two pivoted parts have each a track on its back side around its periphery so that different chessboards can be drawn out and then pushed back into place. The case defines therein a trough covered with a sliding cover board for receiving a variety of writing materials, and a plurality of raised grooves for receiving different pieces which are simultaneously used as color-crayons and chessmen.

3 Claims, 4 Drawing Sheets

COLOR-CRAYONS AND BOARDGAMES COMBINATION SET

BACKGROUND OF THE INVENTION

The present invention is to provide a color-crayons and board games combination set, which combines color-crayons and several board games into a set.

Board games are games of skill played on a chessboard, which help people prompt mental development. A board game set is generally designed for a specific game of chess. Therefore, different board game sets are required for different games of chess.

Further, color-crayons and a variety of writing materials are commonly used by people and more particularly by school children for writing and drawing. A school child may have to prepare different containers for receiving a complete set of color-crayons and a variety of writing materials.

It is an idea of the present inventor to design a case for receiving a full set of color-crayons and a variety of writing materials as well as different board game sets so as to minimize space occupation and provide multiple functions.

SUMMARY OF THE INVENTION

The present invention has been accomplished under the circumstances in view. It is the main object of the present invention to provide a color-crayons and board games combination set which combines color-crayons and various games of chess into a set convenient for use and play.

To accomplish the above object, a color-crayons and board games combination set of the present invention is comprised of a case, different chessboards and different places. The case is comprised of two pivoted parts having each a track on its back side around its periphery so that different chessboards can be drawn out and then pushed back into place. Various grooves are made inside the case for receiving the pieces. A trough is also made inside the case for receiving a variety of writing materials. The pieces are each comprised of a penholder for holding a color-crayon or marking pen, a cap shaped to serve as a symbol for a chessman, and one or more elements respectively marked with a symbol for a chessman.

BRIEF DESCRIPTION OF THE PRESENT INVENTION

DETAILED DESCRIPTION OF THE PREFERRED EMBODIMENTS

Figures 1, 2:
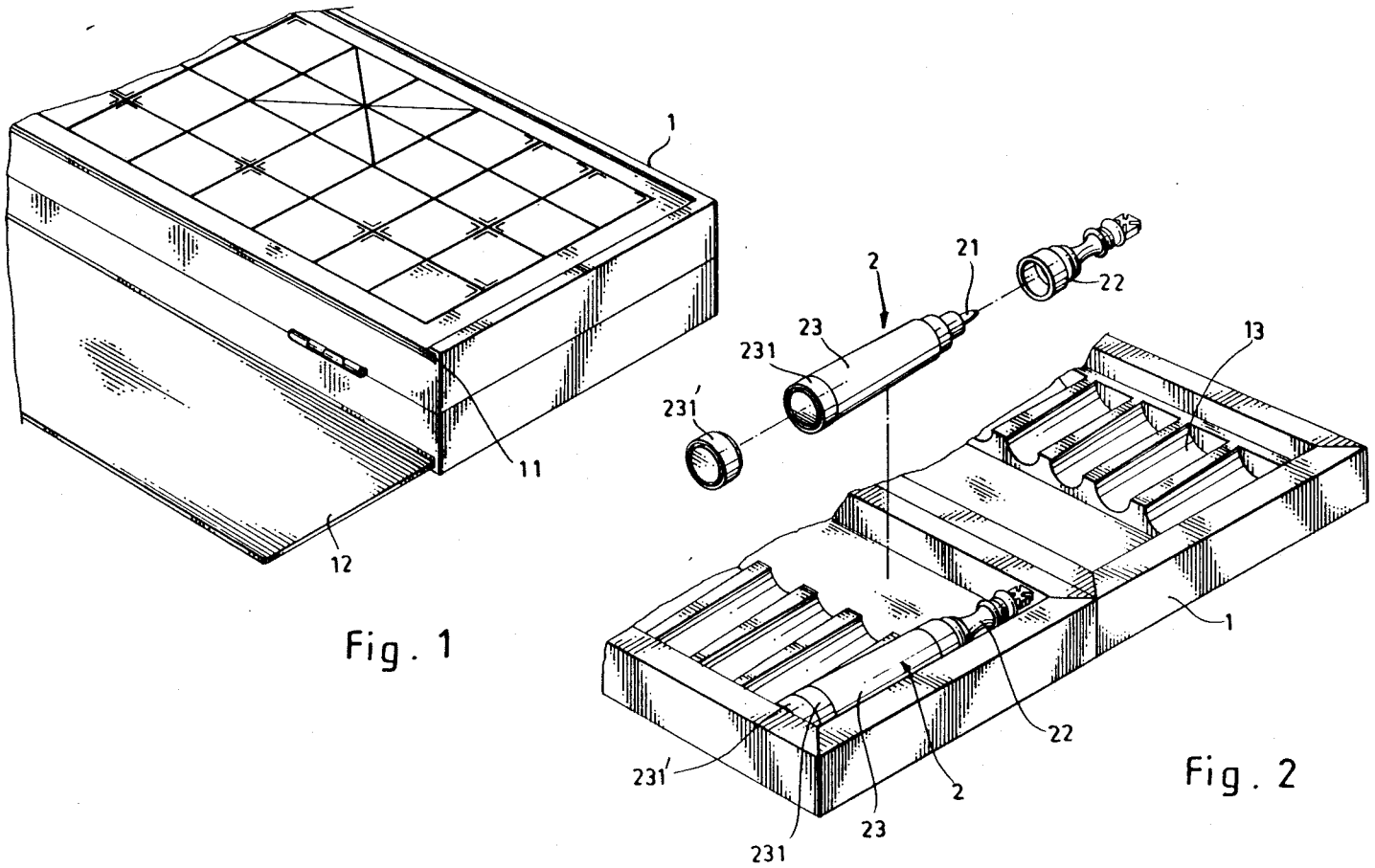
FIG. 1 is a perspective assembly view of the present invention.
FIG. 2 is a perspective exploded view of a piece according to the present invention.
Figure 4:
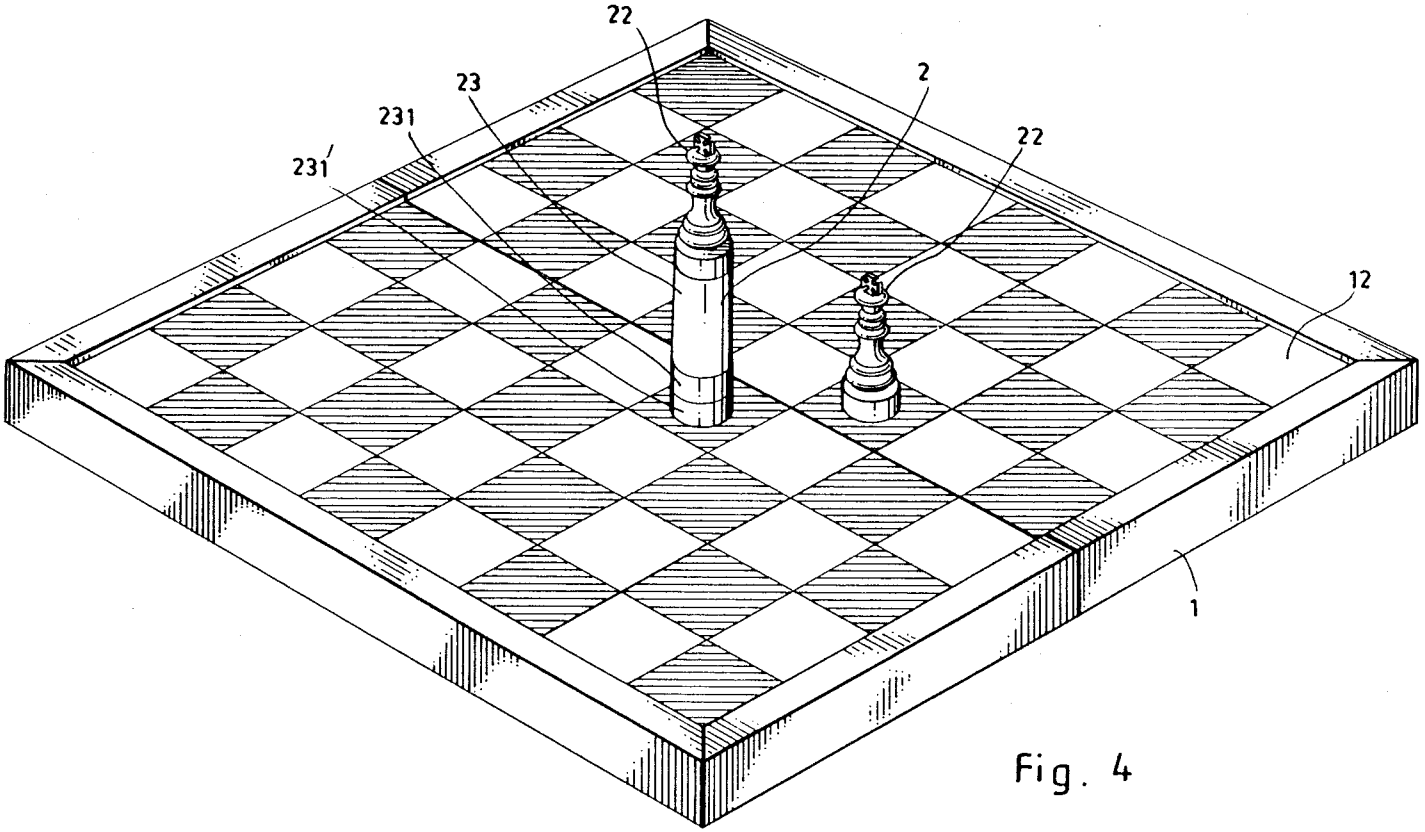
FIG. 4 is a schematic drawing of the present invention, in which the combination set is arranged for playing chess game.
Figure 5:
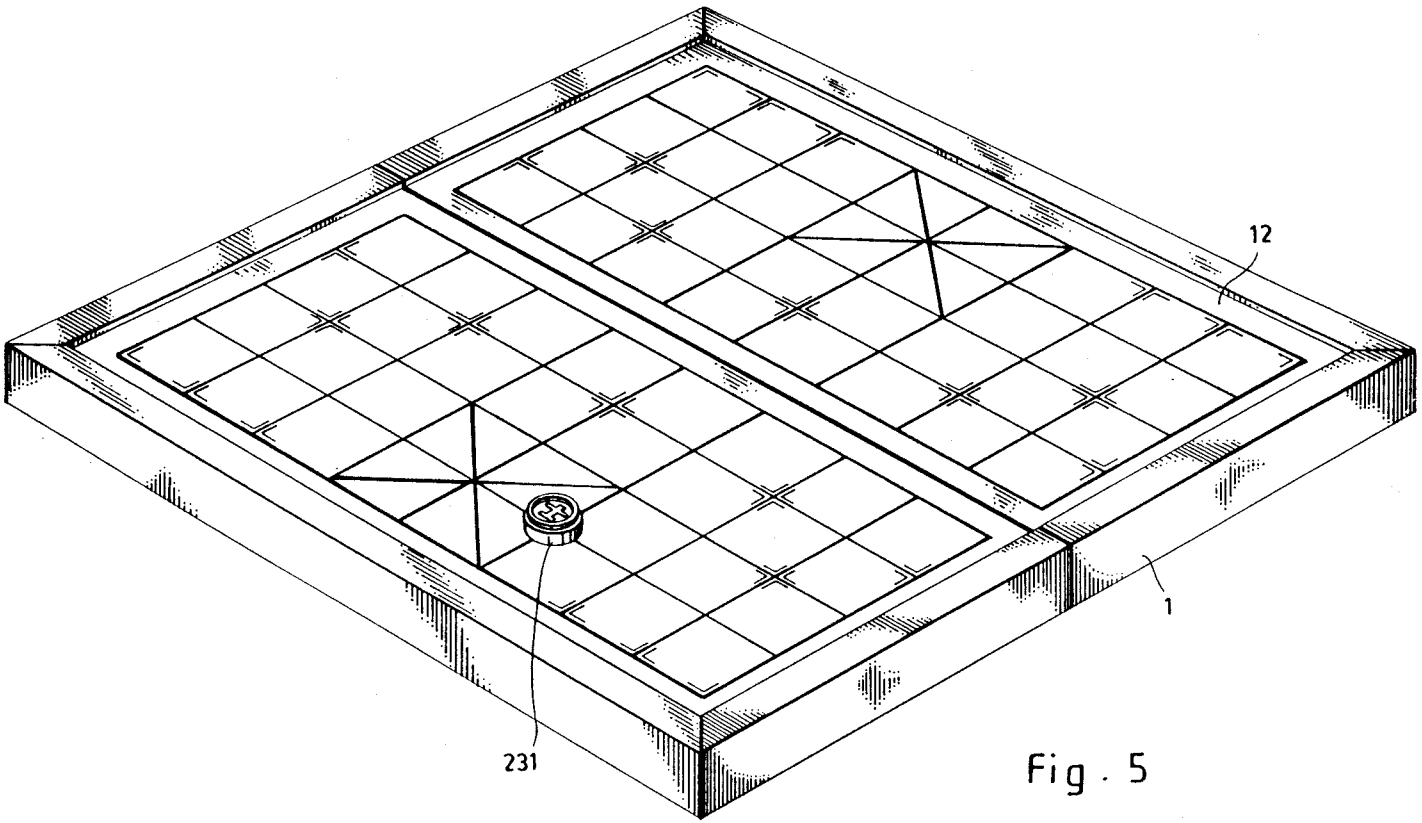
FIG. 5 is a schematic drawing of the present invention, in which the combination set is arranged for playing Chinese chess game.

Referring to FIG. 1, a color-crayons and board games combination set comprises a case 1 formed of two pivoted parts having each a track 11 around its periphery with a plurality of boards 12 set therein, which boards 12 can be drawn out and then pushed back into place. The boards 12 are designed for playing different board games. After the two pivoted parts of the case 1 are extended in a line, the upper two boards on the two pivoted parts form a complete chessboard as shown in FIG. 4. The boards may be changed so as to provide a Chinese chessboard as shown in FIG. 5, or a board for other kinds of board games.

Figure 3:
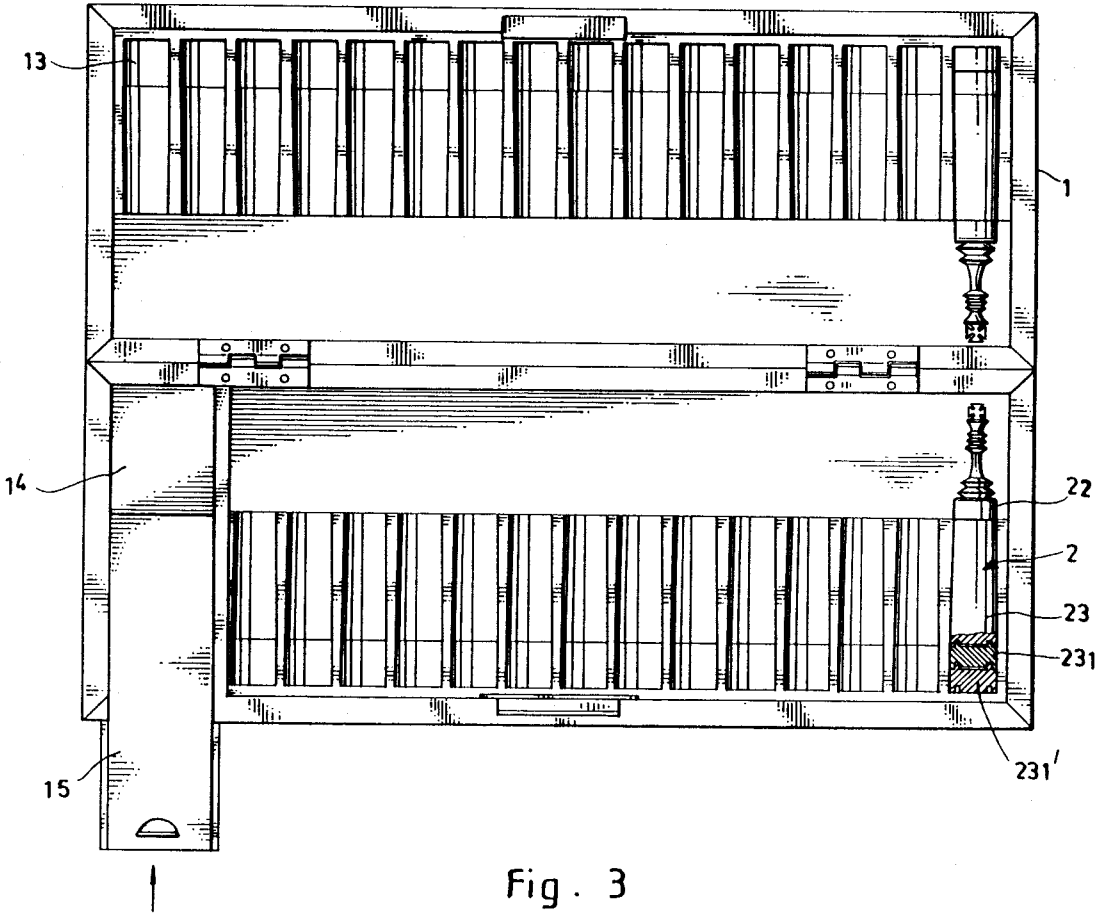
FIG. 3 is a schematic drawing of the case showing its inner composition.

Referring to FIGS. 2 and 3, the case comprises therein a trough 14 for receiving a variety of writing materials (such as pencils, erasers, pins etc., ) and covered with a sliding cover board 15, and a plurality of raised grooves 13 for receiving different pieces 2.

Referring to FIG. 2 again, a piece 2 in accordance with the present invention is generally comprises of a penholder 23 for holding a color-crayon (or marking pen) 21, a cap 22 shaped to serve as a symbol for a chessman, and one or more elements 231, 231′ respectively marked with a symbol for a chessman. When a piece 2 is set in a raised groove 13 inside the case 1, its cap 22 extending out of the front end of such a groove 13 so that it can be conveniently picked up from such a groove 13. According to the aforesaid description, a piece 2 can be used as a color-crayon (marking pen) for drawing or as a chessman for playing board game. As soon as the color-crayon (marking pen) 21 of a piece 2 is used up, a new color-crayon (marking pen) 21 can be refurnished or the cap 22 and the elements 231, 231′ of such a piece 2 can be kept for use as chessman for playing different board games. When in use either a complete piece 2, a cap 22 or a piece 231 or 231′ can be used as a chessman for playing a board game (see FIGS. 4 and 5).

It is to be understood that the above drawings and description are for better understanding of the present invention and not intended as a definition of the limits and scope of the invention disclosed. Recognizing that various modifications been apparent the scope herein shall be defined in the claim as set forth hereinafter.

I claim:

1. A color-crayons and board games combination set, comprising a case comprised of two pivoted parts, said pivoted parts having each a track on its back side around its periphery with a plurality of boards set therein and defining therein a trough for receiving a variety of writing materials, said trough being covered with a sliding cover board, and a plurality of raised grooves for receiving different pieces, said pieces being each used as a color-crayon and a chessman for a board game.

2. The color-crayons and board games combination set of claim 1, wherein said boards are each or each two of which forming a chessboard for playing a board game.

3. The color-crayons and board games combination set of claim 1, wherein said pieces are each comprised of a penholder for holding a color-crayon or marking pen, a cap shaped to serve as a symbol for a chessman, and one or more elements respectively marked with a symbol for a chessman.

* * * * *